United States Patent [19]

Batistoni

[11] 4,422,499

[45] Dec. 27, 1983

[54] MAKING OF STEAM GENERATOR WATER BOXES

[75] Inventor: Michel Batistoni, Dracy le Fort, France

[73] Assignee: Framatome, Courbevoie, France

[21] Appl. No.: 190,391

[22] Filed: Sep. 24, 1980

[30] Foreign Application Priority Data

Oct. 8, 1979 [FR] France ..... 79 24986

[51] Int. Cl.[3] ..... F22B 1/134; F28F 9/22

[52] U.S. Cl. ..... 165/71; 165/158; 122/511

[58] Field of Search ..... 165/71, 176, 158; 122/510, 511

[56] References Cited

U.S. PATENT DOCUMENTS 1,831,337 11/1931 Bennett ..... 165/71

4,285,396 8/1981 Schwoerer et al. ..... 165/510 X

*Primary Examiner*—William R. Cline

*Assistant Examiner*—John F. McNally

*Attorney, Agent, or Firm*—Pollock, Vande Sande & Priddy

[57] ABSTRACT

A heat exchanger water box for steam generators bounded by a hemispherical base and a tube sheet on which the ends of the U-shaped tubes of the exchanger are fixed, on either side of a partition plate separating the water box into two chambers, respectively for supply and evacuation. The partition plate (3) fits with clearance over its whole periphery into a circular groove and a diametrical groove (11) respectively provided in the inner walls of the hemispherical base (2) and the tube sheet (1), and the hemispherical base (2) has at least one drain orifice (26) passing through it which opens at the lowest point of the circular groove for fitting the plate.

4 Claims, 4 Drawing Figures

MAKING OF STEAM GENERATOR WATER BOXES

FIELD OF THE INVENTION

The object of the invention is improvements in the manufacture of heat exchanger water boxes and particularly steam generator water boxes.

BACKGROUND

It is known that, in nuclear power stations, and particularly in so-called pressurized water power stations, the water heated in the nuclear reactor is used to produce steam in heat exchangers termed steam generators, which have a bank of tubes through which passes the primary hot water circuit, positioned in a vessel in which the water of the secondary circuit is changed into steam.

In state of the art installations, the tubes of the primary circuit each form a U whose ends are fixed on a tube sheet provided with two series of orifices corresponding respectively to the inlet and outlet for the primary fluid.

The water box used to supply and remove the primary fluid is bounded at its upper part by the tube sheet on which a hemispherical base is fixed, divided into two parts by a semi-circular partition plate positioned in a diametrical plane. The water box is thus divided into two chambers, respectively for supply and evacuation and the hemispherical base is therefore provided with connection pipes, respectively for inlet and outlet conduits for the primary fluid. In addition, the hemispherical base is also provided with man-holes allowing access to each of the two chambers of the water box.

To date, it has seemed necessary to weld the partition plate onto the tube sheet along its upper rectilinear edge and onto the hemispherical base along its circular edge. Generally, the tube sheet is made of carbon steel coated with stainless steel, the hemispherical base is made of cast or forged steel, and the partition plate is made of solid stainless steel. The welds are consequently difficult to produce and test, the welding causes deformations which make bringing the base up to the tube sheet tricky when the water box is assembled, and the residual stresses induced cannot always be eliminated by relieving the tension. Until now, these various problems have been only partly solved, for example by fixing a connecting piece to the lower face of the tube sheet which facilitates welding of the partition plate.

However, in addition, because of the differential deformations of the tube sheet and the hemispherical base, calculation of the mechanical behavior of the partition plate connected rigidly to the two parts is very tricky.

Moreover, the division of the hemispherical base into two chambers presents another disadvantage. In practice, it is sometimes necessary to gain access to the interior of the water box for inspection and maintenance operations. It is essential in this instance to entirely empty the water box of the contaminated water it contains. To accomplish this, in each chamber, at the lower part of the hemispherical base, it is necessary to pierce drain orifices which open into the pipe for the inlet or outlet of the primary fluid. But to completely empty the space bounded by the man-hole closing plate and its cylindrical inner face positioned in the depth of the hemispherical base, other drain orifices in the inner wall of the man-hole must also be pierced.

These various drain orifices are difficult to machine and always run the risk of being blocked by deposits. They can also slightly weaken the wall of the hemispherical base just where the pipes start.

SUMMARY OF THE INVENTION

The improvements according to the present invention allow all these difficulties to be resolved.

In conformity with the invention, the partition plate fits with clearance over its whole periphery into a circular groove, and a diametrical groove provided respectively on the inner walls of the hemispherical base and the tube sheet and at least one drain orifice passes through the hemispherical base to open at the lowest point of the circular groove for fitting the sheet, the said orifice being capable of communicating with the two chambers of the water box.

Thus, the best possible attachment of the partition plate to the base and the tube sheet is no longer required. Instead, the partition plate is mounted so as to be freely expansible without impeding the differential deformations of the tube sheet and the hemispherical base. It has in fact been established that it is possible to preserve the function of the plate in separating the water box, into two chambers while reducing the by-passes to the minimum, without fixing it rigidly to the walls of the water box. In this way, it is far easier to make allowance for deformations of the water box and all the difficulties inherent in producing the welds are avoided.

In addition, by assuring a connection with clearance between the partition plate and the hemispherical base, drainage of the water box is facilitated. The said clearance in fact allows communication between the two chambers of the water box and a single drain orifice positioned at the lowest point of the hemispherical base. The drain orifices heretofore provided in the two connection pipes for inlet and outlet conduits for the primary fluid are therefore eliminated, and the single orifice according to the invention can be made far more easily.

BRIEF DESCRIPTION OF THE DRAWINGS

The invention will be more easily understood with reference to a particular embodiment represented in the attached drawings.

DETAILED DESCRIPTION

Figure 2:
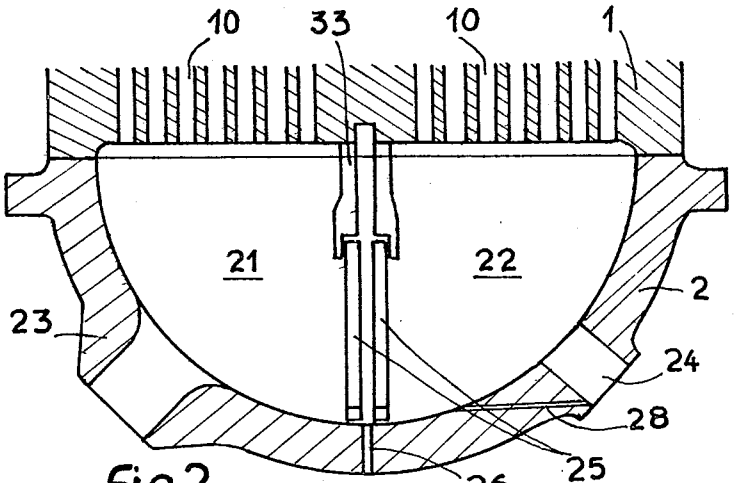
FIG. 2 is a sectional view at II—II, FIG. 1, with the partition plate removed.
Figure 1:
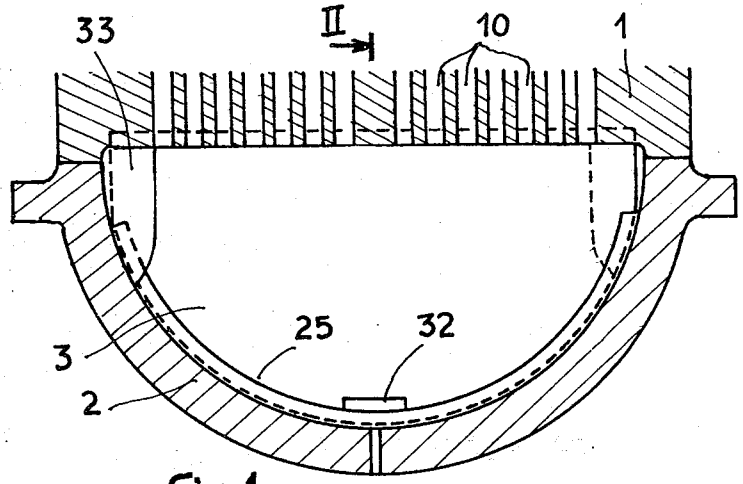
FIG. 1 is a view of the improved water box according to the invention, sectioned in the plane of the partition plate.

In FIGS. 1 and 2, the water box bounded at its upper part by the tube sheet 1 and at its lower part by the hemispherical base 2 has been represented in section. The partition plate 3 removed in FIG. 2 divides the water box into two chambers 21 and 22, respectively for admission and evacuation of the primary fluid. This flows from one chamber to the other in U-shaped tubes (not shown) whose ends correspond to orifices 10 provided in the tube sheet.

For each of the chambers 21 and 22, the hemispherical base is provided with a pipe 23 to which the conduit for circulation of the primary fluid is connected and a man-hole 24 allowing access to the interior of the corresponding chamber.

For the sake of convenience, the supply pipe 23 opening into the chamber 21 and the man-hole 24 opening into the chamber 22 have been shown in arbitrary positions.

Figure 3:
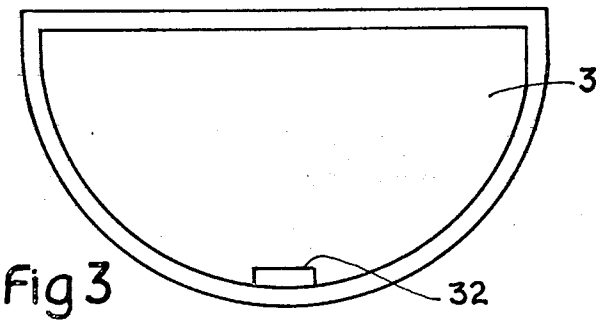
FIG. 3 is a front view of the partition plate alone.
Figure 4:
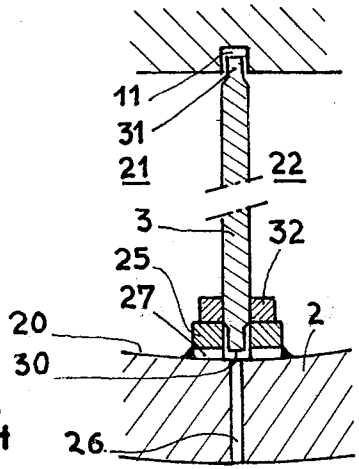
FIG. 4 is a detail view, in transverse section, of the connection between the partition plate and the tube sheet and the hemispherical base.

The partition plate 3 is represented from the front in FIG. 3. It has the conventional semi-circular shape and, as shown in FIG. 4, it is preferably provided with a reduction in thickness over its whole periphery. In this way, it can enter into grooves provided in the tube sheet 1 and on the hemispherical base 2 with clearance. In the example represented, the upper groove 11 is constituted by a groove made in the lower face of the tube sheet, and in which the upper rectilinear edge 31 of the partition plate 3 engages.

To avoid making a groove in the hemispherical base, the circular groove can be constituted by two parallel ribs 25 spaced from each other by a distance substantially equalling the thickness of the partition plate 3 and welded onto the hemispherical base 2. The plate 3 enters between the two ribs 25 with clearance.

To obtain a clearance between the lower edge 30 of the partition plate 3 and the inner wall 20 of the hemispherical base, the partition plate 3 can be made to rest directly on the ribs 25 through support blocks 32, for example.

In addition, the hemispherical base 2 has, at its lowest point, an orifice 26 passing through it which thus opens at the lowest point of the circular groove, between the two ribs 25. The latter are provided with passages 27 which allow the orifice 26 to communicate with the two chambers 21 and 22 of the water box.

The arrangements just described allows several advantages to be combined.

First, the partition plate 3 is independent of the walls bounding the water box. It is actually simply supported on the hemispherical base 2 by the blocks 32, and its upper part can slide freely inside the groove 11 of the tube sheet 1. All deformations and residual stresses due to the welded attachment of the partition plate in conventional constructions are thus eliminated. In addition, the partition plate does not interfere with the deformations of the water box, which can thus be designed and consequently tested far more easily.

This solution also allows use of cheaper materials since the relative expansibilities of the various materials constituting the three parts of the water box no longer need to be included in calculations of strength.

In addition, the clearance between the lower part of the partition plate 3 and the inner wall of the hemispherical base 2 allows the two chambers 21 and 22 to be made to communicate with a single drain orifice 26, which allows the water contained in the chambers 21 and 22 below the lower level of the pipe-orifices to be totally evacuated. The cutting of channels, which are quite difficult to pierce, in the thickness of the pipes, and which also must be long enough to open at the lowest point of the water box and can consequently easily be blocked by deposits, is thus avoided. In the embodiment according to the invention, it is only necessary to provide drain channels 28 opening at the lower part of the man-holes 24 to remove the water contained in the thickness of the wall of the base 2.

Lastly, on assembling the water box, the fitting of the partition plate facilitates bringing the base up to the tube sheet.

These various advantages of the invention are obtained simply by allowing a slight by-pass between the two chambers, which is also very limited by the fact that the partition plate fits into the grooves. The latter must, however, be interrupted at certain places and especially at the upper part of the hemispherical base so that the latter can be welded to the tube sheet. Flat cover plates 33, as shown in FIG. 1, allow passage between the two chambers to be substantially limited.

The invention is not limited to the details of the embodiment just described and can be modified, especially by using equivalent means. Thus, the grooves into which the partition plate fits could be achieved in another way, as could the support of the partition plate on the hemispherical base.

What is claimed is:

1. Water box for a steam generator having a bank of U-shaped tubes whose ends are fixed to a tube sheet, said water box comprising a substantially hemispherical base (2) applied to said tube sheet (1) and bounding a space divided into a supply chamber (21) and an evacuation chamber (22) by a semi-circular partition plate (3) which fits with clearance over its whole periphery into a circular groove and a diametrical groove (11) respectively provided in the inner walls of said hemispherical base (2) and said tube sheet (1), said hemispherical base (2) having at least one drain orifice (26) passing through it which opens at the lowest point of said circular groove for fitting said plate (3), said orifice (26) being capable of communicating with the two chambers (21, 22) of said water box.

2. Water box according to claim 1, wherein said partition plate (3) rests on said hemispherical base (2) on blocks (32) so as to maintain a clearance between the lower edge (30) of said plate (3) and the bottom of said circular groove, the upper edge (31) of said plate being freely slidable in said groove (11) of said tube sheet as a function of the differential deformations of the parts constituting said water box.

3. Water box according to claim 1 or 2 wherein said groove for fitting said partition plate (3) is provided in the depth of the corresponding wall of said water box.

4. Water box according to claim 2, wherein said circular groove is delimited by two parallel ribs (25) provided on the inner face of said hemispherical base (2), passages (27) being provided at the lower part of said ribs (25) for communicating with said drain orifice (26) of said hemispherical base (2).

* * * * *